US010620584B2

(12) United States Patent
Sawada

(10) Patent No.: US 10,620,584 B2
(45) Date of Patent: Apr. 14, 2020

(54) IMAGE FORMING APPARATUS

(71) Applicant: CANON KABUSHIKI KAISHA, Tokyo (JP)

(72) Inventor: Masashi Sawada, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/429,466

(22) Filed: Jun. 3, 2019

(65) Prior Publication Data

US 2019/0369554 A1 Dec. 5, 2019

(30) Foreign Application Priority Data

Jun. 5, 2018 (JP) ..... 2018-107415

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS

2011/0249982 A1* 10/2011 Sato ..... G03G 21/206 399/92

FOREIGN PATENT DOCUMENTS

JP 2013-074083 A 4/2013

* cited by examiner

*Primary Examiner* — G.M. A Hyder
(74) *Attorney, Agent, or Firm* — Venable LLP

(57) ABSTRACT

An image forming apparatus includes:

an exterior of a main body of the image forming apparatus, the exterior including a vent hole;

a substrate provided in an inner side of the main body with respect to the exterior so as to face the vent hole and configured to mount an electronic component; and a sheet member including a hole and flexibility, the sheet member being disposed so that the hole and the vent hole overlap with each other at a position between the exterior and the substrate, the sheet member being formed in a loop shape so that a portion that does not have the hole covers the hole with a gap.

8 Claims, 7 Drawing Sheets

IMAGE FORMING APPARATUS

BACKGROUND OF THE INVENTION

Field of the Invention

The present invention relates to an image forming apparatus such as an electrophotographic copying machine and an electrophotographic printer.

Description of the Related Art

In an image forming apparatus, a power supply substrate for supplying power to a main body of the image forming apparatus, and a controller substrate for performing arithmetic processing for outputting an image of received image data are mounted.

Here, Japanese Patent Laid-Open No. 2013-74083 discloses a configuration in which a vent hole is provided at a position facing the controller substrate in the exterior of the image forming apparatus in order to suppress a temperature rise of an electronic component mounted on the controller substrate.

In recent years, the image forming apparatus has been required to satisfy product safety standard IEC 62368-1. An example of this product safety standard can include dimension regulations for an opening of an enclosure present within a predetermined dimension range from an energy source or regulations related to isolation from the energy source.

Therefore, the present invention has been made in view of such a current situation, and it is desirable to provide an image forming apparatus capable of securing air permeability around a substrate while satisfying product safety standard IEC 62368-1.

SUMMARY OF THE INVENTION

According to an aspect of the present invention, an image forming apparatus includes:

- an exterior of a main body of the image forming apparatus, the exterior including a vent hole;
- a substrate provided in an inner side of the main body with respect to the exterior so as to face the vent hole and configured to mount an electronic component; and
- a sheet member including a hole and flexibility, the sheet member being disposed so that the hole and the vent hole overlap with each other at a position between the exterior and the substrate, the sheet member being formed in a loop shape so that a portion that does not have the hole covers the hole with a gap.

Further features of the present invention will become apparent from the following description of exemplary embodiments with reference to the attached drawings.

DESCRIPTION OF THE EMBODIMENTS

First Embodiment

<Image Forming Apparatus>

Hereinafter, an overall configuration of an image forming apparatus according to a first embodiment of the present invention will be described with reference to the drawings, together with an operation at the time of image formation. Dimensions, materials, shapes, relative arrangements, and the like of components described below are not intended to limit the scope of the present invention unless specifically stated otherwise.

The image forming apparatus according to the present embodiment is an electrophotographic image forming apparatus which transfers toners of four colors of yellow Y, magenta M, cyan C, and black K to an intermediate transfer belt, and then transfers an image to a sheet to form the image. In the following description, Y, M, C, and K are added as subscripts to members using the toners of the respective colors, but since configurations or operations of the respective members are substantially the same as one another except that colors of the toners used in the respective members are different from one another, the subscripts are appropriately omitted unless it is necessary to distinguish the configurations or the operations of the respective members from one another.

Figure 1:
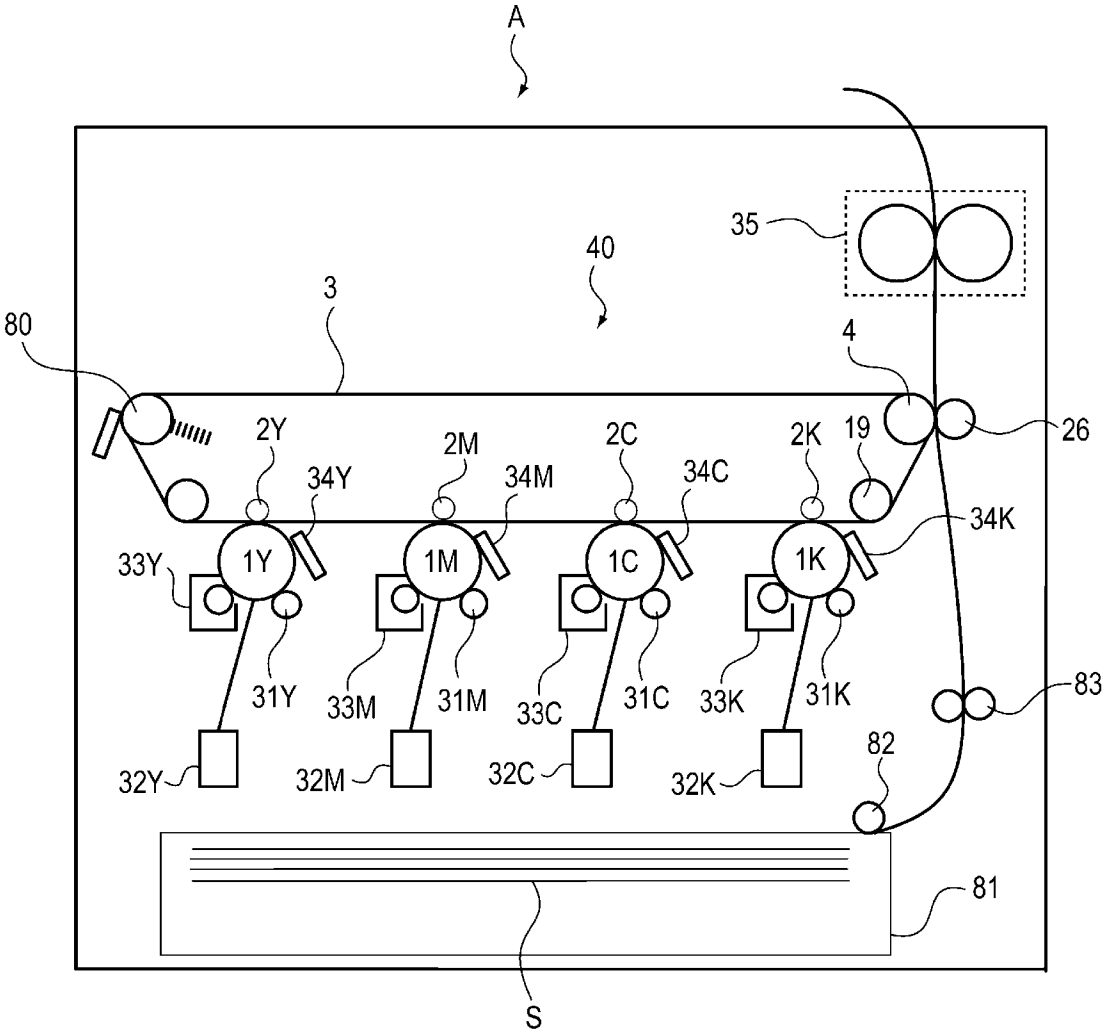
FIG. 1 is a schematic cross-sectional view of an image forming apparatus.

As illustrated in FIG. 1, an image forming apparatus A includes an image forming portion which forms an image by transferring a toner image to a sheet, a sheet feeding portion which supplies the sheet toward the image forming portion, and a fixing portion which fixes the toner image to the sheet.

The image forming portion includes a photosensitive drum 1 (1Y, 1M, 1C, and 1K), a charging roller 31 (31Y, 31M, 31C, and 31K) which charges a surface of the photosensitive drum 1 (1Y, 1M, 1C, and 1K), and a developing device 33 (33Y, 33M, 33C, and 33K). In addition, the image forming portion includes a primary transfer roller 2 (2Y, 2M, 2C, and 2K), a laser scanner portion 32 (32Y, 32M, 32C, and 32K), a cleaning blade 34 (34Y, 34M, 34C, and 34K), and an intermediate transfer portion 40.

The intermediate transfer portion 40 includes an intermediate transfer belt 3, a secondary transfer roller 26, a secondary transfer counter roller 4, a stretching roller 19, and a tension roller 80. The intermediate transfer belt 3 is an endless belt stretched over the secondary transfer counter roller 4, the stretching roller 19, and the tension roller 80, the secondary transfer counter roller 4 rotates by a driving force of a driving source, and the intermediate transfer belt 3 circularly moves depending on the rotation of the secondary transfer counter roller 4.

Next, an image forming operation will be described. First, when a controller (not illustrated) receives an image forming job signal, sheets S stacked and stored on a sheet stacking portion 81 are fed to a secondary transfer portion including the secondary transfer roller 26 and the secondary transfer counter roller 4 by a feeding roller 82 and a conveying roller 83.

Meanwhile, in the image forming portion, first, the surface of the photosensitive drum 1 is uniformly charged by the charging roller 31. Then, the laser scanner portion 32 irradiates the surfaces of the photosensitive drums 1 for the respective colors with a laser flux from a light source (not illustrated) depending on image data transmitted from an external device (not illustrated) or the like to form electrostatic latent images on the surfaces of the photosensitive drums 1.

Then, toners of the respective colors are attached to the electrostatic latent images formed on the surfaces of the photosensitive drums 1 by the developing device 33 to form toner images on the surfaces of the photosensitive drums 1. The toner images formed on the surfaces of the photosensitive drums 1 are primarily transferred to the intermediate transfer belt 3, respectively, by applying a primary transfer bias to the primary transfer roller 2. As a result, a full-color toner image is formed on a surface of the intermediate transfer belt 3. The toners attached to the surfaces of the photosensitive drums 1 after being primarily transferred are scraped and removed by the cleaning blade 34.

Then, the toner images are sent to the secondary transfer portion by circularly rotating the intermediate transfer belt 3. Then, the toner images on the intermediate transfer belt 3 are transferred to the sheet S by applying a secondary transfer bias to the secondary transfer roller 26 in the secondary transfer portion.

Then, the sheet S to which the toner image is transferred is subjected to heating and compressing processing in a fixing device 35, such that the toner image on the sheet S is fixed to the sheet S. Then, the sheet S to which the toner image is fixed is discharged to the outside of the image forming apparatus A.

<Power Supply Substrate>

Next, a power supply substrate 51 which is an energy source for supplying power to the image forming apparatus A and a configuration around the power supply substrate 51 will be described. In the present embodiment, the power supply substrate 51 is a substrate for supplying power to the fixing device 35.

Figure 2:
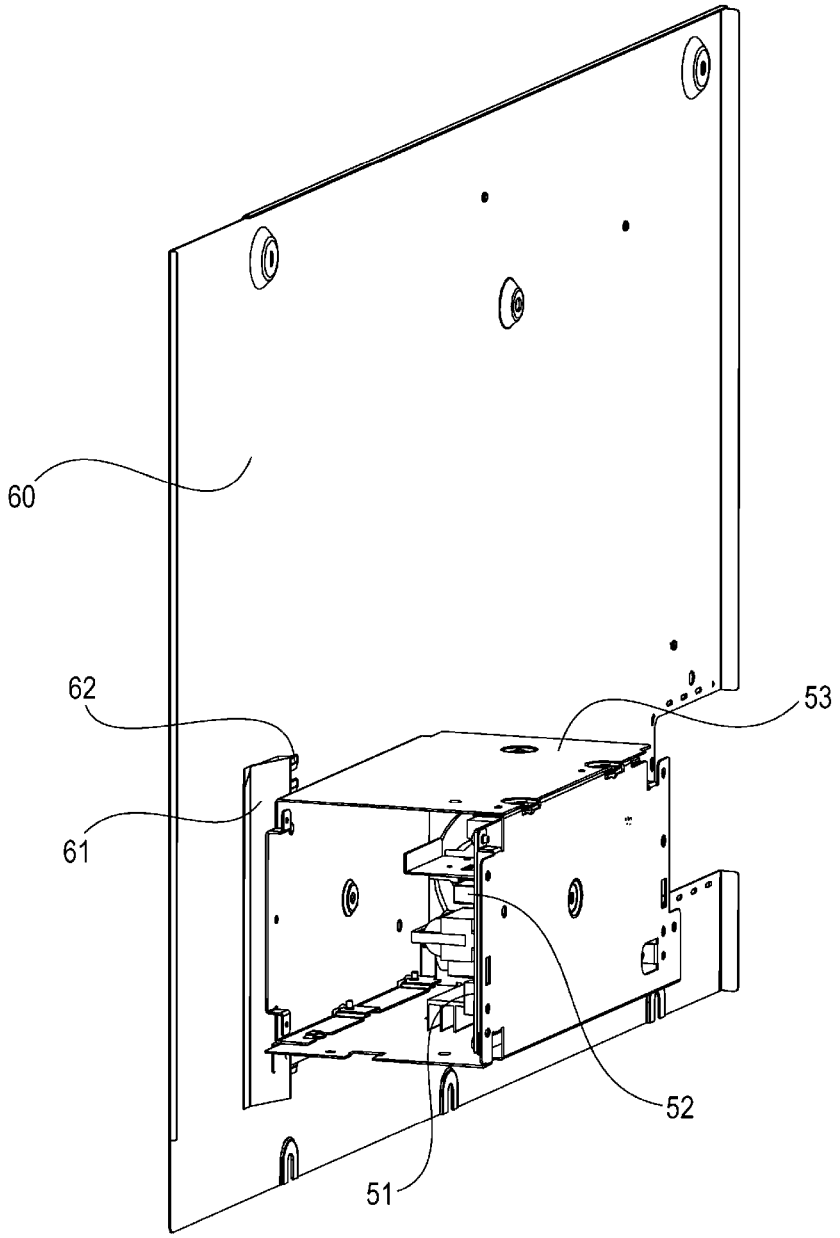
FIG. 2 is a perspective view of a rear cover.

FIG. 2 is a perspective view of a rear cover 60 which is an exterior of a rear side of the image forming apparatus A. As illustrated in FIG. 2, the power supply substrate 51 for supplying the power to the image forming apparatus A is provided inside the rear cover 60 (inside the image forming apparatus A). The power supply substrate 51 is held so as to be partially covered by a power supply case 53 (holding member) supported by a frame (not illustrated) of a main body of the image forming apparatus A. Side surfaces of the power supply case 53 are open, in order to secure air permeability and lay a wiring such as a cable connected to the power supply substrate 51.

In addition, in the rear cover 60, a plurality of vent holes 62 is provided at a position facing the power supply substrate 51 through the power supply case 53. The vent holes 62 are provided around the power supply substrate 51 as described above, such that a temperature rise of an electronic component mounted on the power supply substrate 51 is suppressed.

In addition, the power supply substrate 51 is mounted with a varistor 52 (protective member) having non-linear voltage-current characteristics in which an electric resistance is reduced when a predetermined voltage or more is applied. The varistor 52 has surge absorption characteristics to protect another electronic component mounted on the power supply substrate 51 from a lightning surge, a transient voltage surge or the like. As a member for protecting another electronic component mounted on the power supply substrate 51, a surge protection device such as an arrester or a surge absorber may be provided instead of the varistor 52.

In addition, a shielding member 61 is provided between the vent holes 62 of the rear cover 60 and the power supply substrate 51. The shielding member 61 is a member that covers the vent holes 62 and is provided so that fragments of the varistor 52 do not scatter from the vent holes 62 to the outside in a case where the varistor 52 is broken.

Figure 3A:
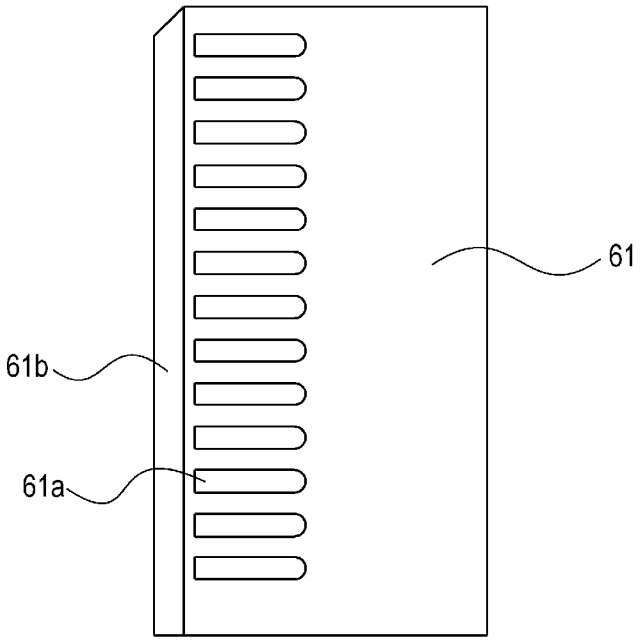
FIGS. 3A and 3B are, respectively, a front view and a rear view of a shielding member before being incorporated into the image forming apparatus.
Figure 3B:
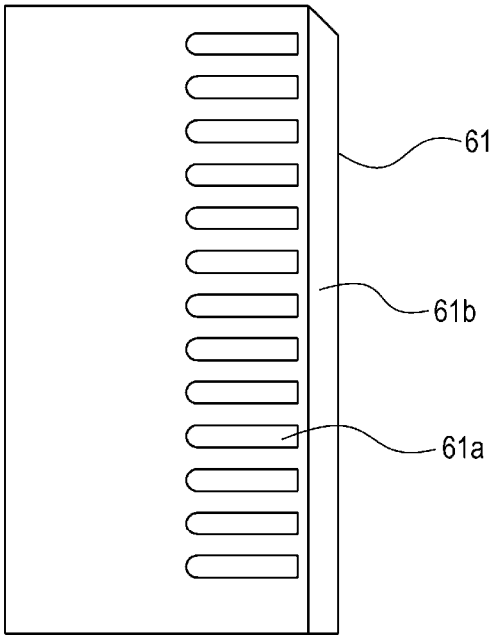
Figure 4A:
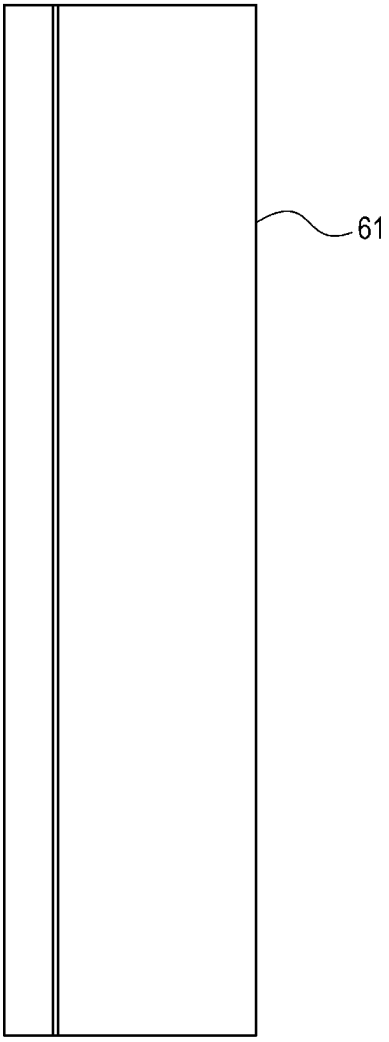
FIGS. 4A, 4B, and 4C are, respectively, a front view, a bottom view, and a rear view of the shielding member in a state of being incorporated into the image forming apparatus.
Figure 4C:
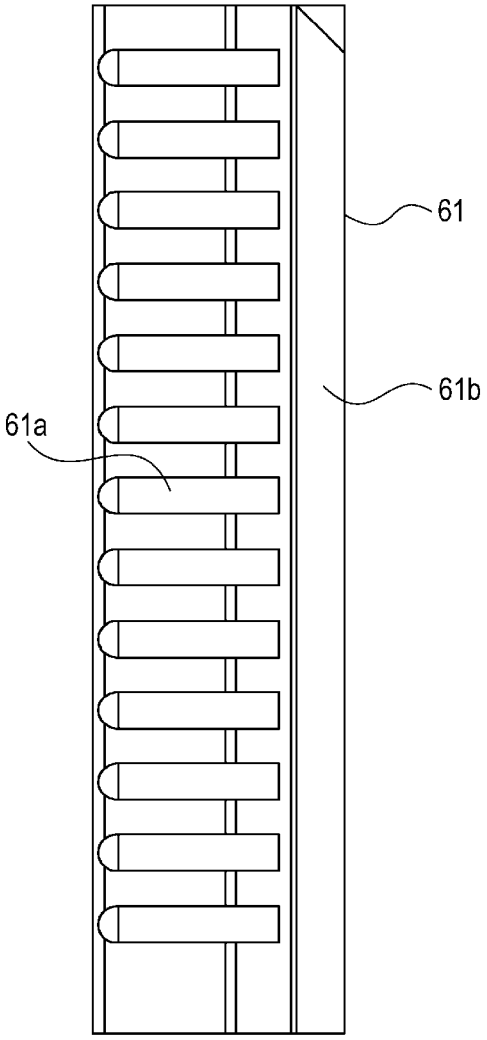
Figure 4B:
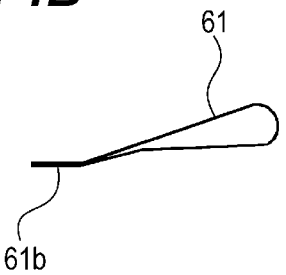

FIGS. 3A and 3B are, respectively, a front view and a rear view of a shielding member 61 before being incorporated into the image forming apparatus A. FIGS. 4A, 4B, and 4C are, respectively, a front view (FIG. 4A), a bottom view (FIG. 4B), and a rear view (FIG. 4C) of the shielding member 61 in a state of being incorporated into the image forming apparatus A.

As illustrated in FIGS. 3A, 3B, and FIGS. 4A to 4C, the shielding member (sheet member) 61 is a sheet-shaped member having flexibility, and is formed of a polyethylene terephthalate sheet (PET sheet) having a thickness of 0.1 mm in the present embodiment. It should be noted that the shielding member 61 can be formed of a frame retardant material.

The shielding member 61 includes a plurality of holes 61*a* and double-sided tape portions 61*b* disposed at end portions of front and rear surfaces thereof. The shielding member 61 is folded back so that an end portion on a side remote from the holes 61*a* is combined with the double-sided tape portion 61*b* on the front surface, such that the shielding member 61 is formed in a loop shape, and is incorporated into the image forming apparatus A in this state. That is, the shielding member 61 is formed in the loop shape by bonding a single sheet at the double-sided tape portion 61*b* as a bonding portion. It should be noted that the double-sided tape portion 61*b* on the rear surface of the shielding member 61 is bonded to the rear cover 60.

Figure 5A:
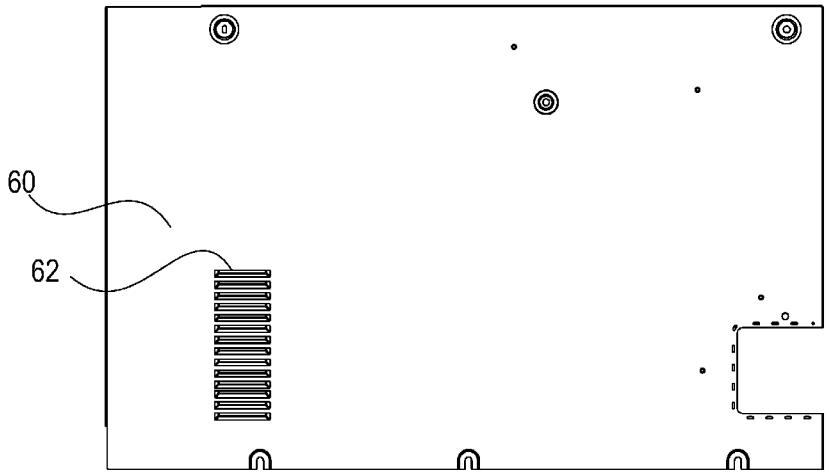
FIGS. 5A and 5B are plan views of an inner surface of the rear cover.
Figure 5B:
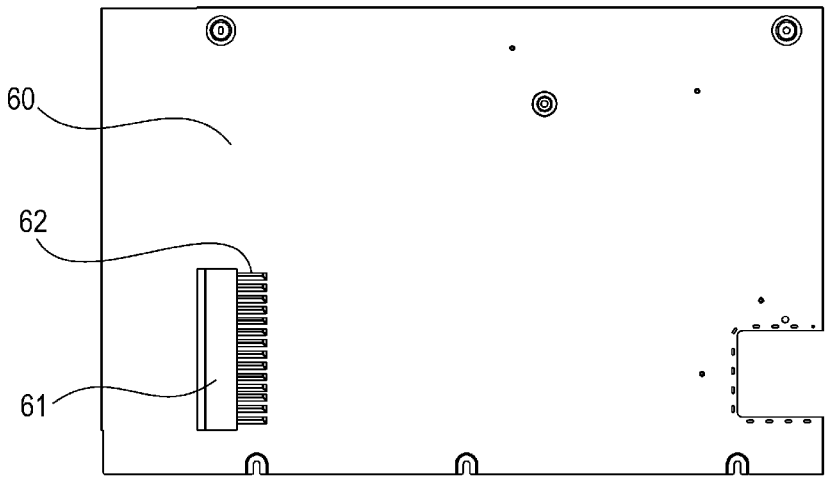

FIGS. 5A and 5B are plan views of an inner surface of the rear cover 60. Here, FIG. 5A is a view illustrating a state before the shielding member 61 is attached to the rear cover 60, and FIG. 5B is a view illustrating a state where the shielding member 61 is attached to the rear cover 60. As illustrated in FIGS. 5A an 5B, the shielding member 61 is disposed so that the holes 61*a* thereof overlap with at least portions of the vent holes 62 of the rear cover 60. In addition, the shielding member 61 is formed in the loop shape, such that a portion that does not have the holes 61*a* covers a portion having the holes 61*a* with a gap. That is, the shielding member 61 is a member disposed so that the holes 61*a* and the vent holes 62 overlap with each other at a position between the rear cover 60 and the power supply substrate 51 and is formed in the loop shape so that the portion that does not have the holes 61*a* covers the portion having the holes 61*a* with the gap.

Figure 6:
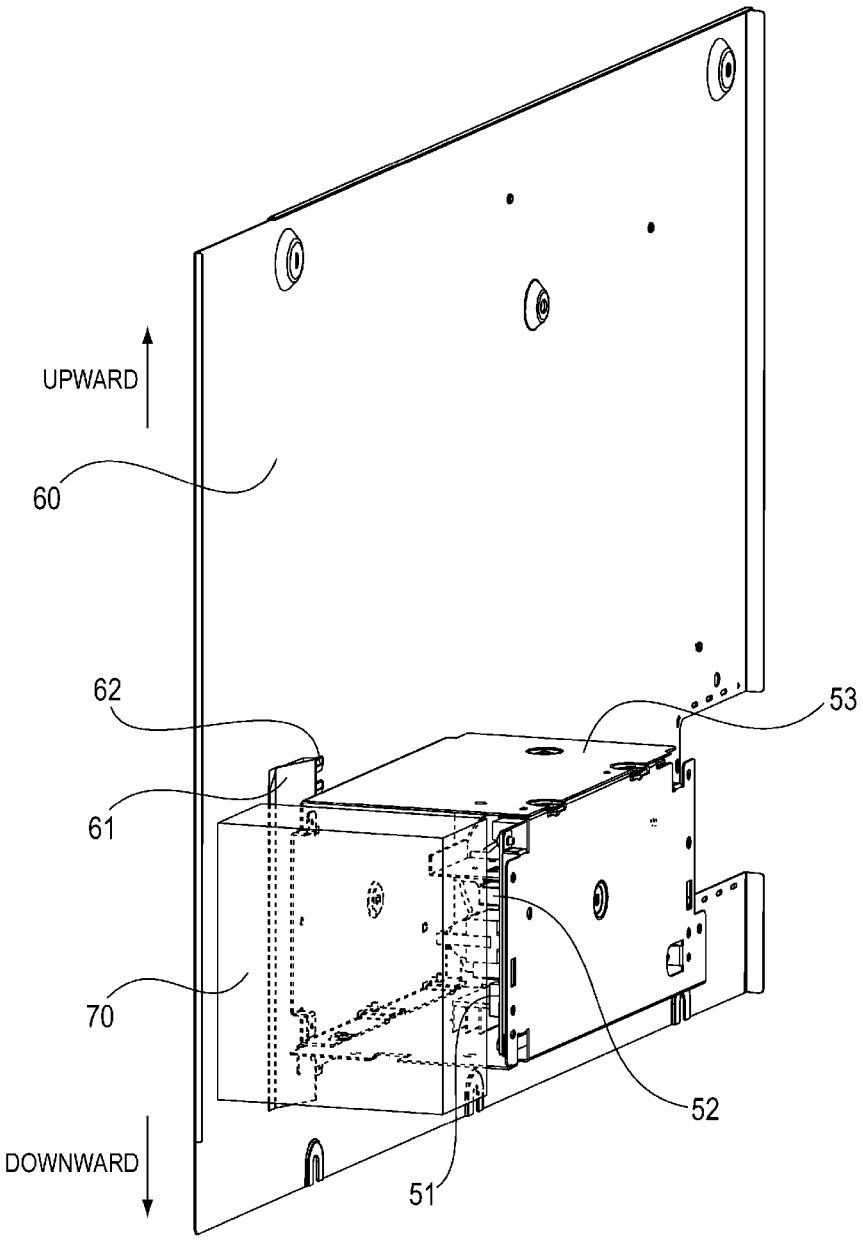
FIG. 6 is a perspective view of the rear cover.
Figure 7:
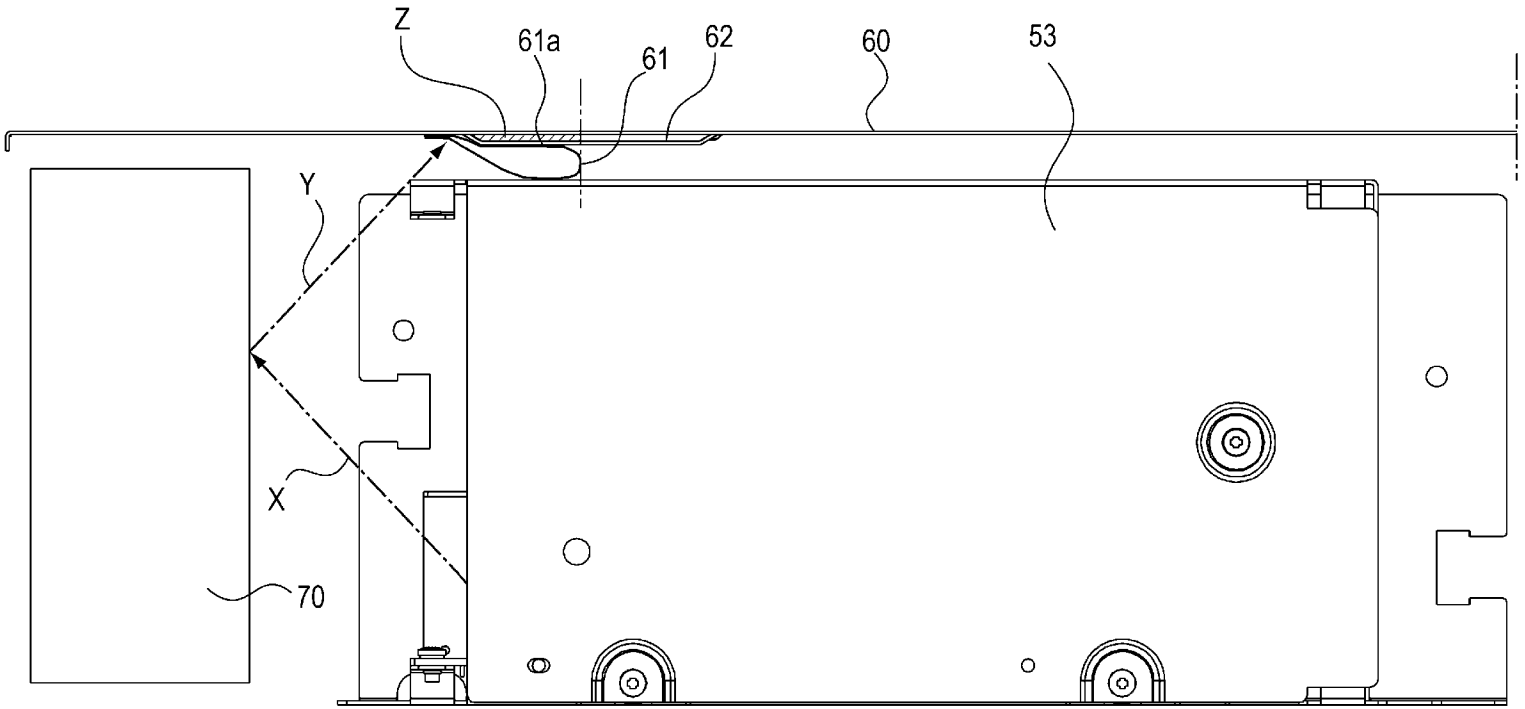
FIG. 7 is a view of the surrounding of the shielding member when viewed from the top.

FIG. 6 is a perspective view of the surrounding of the rear cover 60 when another power supply case 70 is further attached to the image forming apparatus A, and is a view corresponding to a view in which another power supply case 70 is added to a state of FIG. 2. FIG. 7 is a view of the surrounding of the shielding member 61 when viewed from the top, and is a view corresponding to the view of FIG. 6 when viewed from the top toward the bottom. It should be noted that another power supply case 70 holds another power supply substrate (not illustrated) for supplying power to a motor (not illustrated) driving a fan (not illustrated) provided in the vicinity of the fixing device 35.

As illustrated in FIGS. 6 and 7, the power supply case 53 is disposed on a straight line connecting the varistor 52 and the vent hole 62 to each other. In addition, in the shielding member 61, a portion that has the holes 61*a* is covered with a portion that does not have the holes 61*a*. Therefore, in a case where the varistor 52 is broken and fragments of the varistor 52 are thus scattered, the fragments moving directly from the varistor 52 toward the vent holes 62 are shielded by the power supply case 53 or the shielding member 61.

However, the fragments of the varistor 52 do not necessarily move directly to the vent 62. That is, for example, there is also a possibility that the fragments of the varistor 52 scattered in a direction of an arrow X in FIG. 7 may collide with another power supply case 70, turn in the direction of the arrow Y, and move to the vent 62. In this case, the fragments of the varistor 52 move toward the vent holes 62 without colliding with the power supply case 53.

Here, since the shielding member 61 has a sheet shape and elasticity, the shielding member is in contact with the power supply case 53 along a shape of the power supply case 53 at a position between the power supply case 53 and the vent holes 62. For this reason, the fragments colliding with another power supply case 70 are prevented from entering the position between power supply case 53 and the vent holes 62. In addition, in the shielding member 61, a portion that has the holes 61*a* is covered with a portion that does not have the holes 61*a*. Therefore, even though the fragments of the varistor 52 collide with another power supply case 70 and are scattered in the direction of the arrow Y, the fragments collide with a portion of the shielding member 61 where the holes 61*a* are not present, and it is thus possible to suppress the fragments from coming out from the vent holes 62 to the outside by the shielding member 61. In addition, the shielding member 61 is interposed between a substrate, which is a protection target, and the vent holes, such that it is possible to satisfy product safety standard IEC 62368-1. Further, since the holes 61*a* of the shielding member 61 are disposed to overlap with the vent holes 62 and the holes 61*a* are covered with the portion that does not have the holes 61*a* with the gap, air permeability is secured as compared with a configuration in which the vent holes 62 are closed only by a sheet-shaped member.

As described above, according to the configuration of the present embodiment, it is possible to suppress the fragments of the varistor 52 from going around the shielding member 61 and scattering from the vent holes 62 of the rear cover 60 to the outside as well as to secure the air permeability by the shielding member 61. In addition, since the vent holes 62 are shielded by the shielding member 61, it is possible to improve compliance with the product safety standard IEC 62368-1.

In addition, in the present embodiment, in a region where the shielding member 61 and the rear cover 60 overlap with each other, the sum of opening areas of the holes 61*a* is about four times the sum of opening areas of the vent holes 62. Here, the opening areas of the vent holes 62 refer to an area of a region Z indicated by a dot illustrated in FIG. 7. By making the opening areas of the holes 61*a* larger than the opening areas of the vent holes 62 as described above, it becomes easier to secure the air permeability.

In the present embodiment, the shielding member 61 is formed of PET, but the present invention is not limited thereto. That is, even though the shielding member 61 is formed of a metal material such as a material for a leaf spring, the same effect as that described above can be obtained.

In addition, in the present embodiment, the shielding member 61 is provided between the vent holes 62 and the power supply substrate 51, but the shielding member 61 may be provided between a cover portion that covers an exterior of the image forming apparatus and another electrical substrate which is an energy source and is a protection target. For example, the shielding member 61 may be provided between a driver substrate for driving a toner bottle accommodating a toner or a substrate for supplying power to another member, and vent holes 62 formed in an exterior cover.

As described above, according to the present invention, in the image forming apparatus, it is possible to secure the air permeability in the vicinity of the substrate while satisfying the product safety standard IEC 62368-1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-107415, filed Jun. 5, 2018, which is hereby incorporated by reference herein in its entirety.

What is claimed is:

1. An image forming apparatus comprising:

an exterior of a main body of the image forming apparatus, the exterior including a vent hole;

a substrate provided in an inner side of the main body with respect to the exterior so as to face the vent hole and configured to mount an electronic component; and a sheet member including a hole and flexibility, the sheet member being disposed so that the hole and the vent hole overlap with each other at a position between the exterior and the substrate, the sheet member being formed in a loop shape so that a portion that does not have the hole covers the hole with a gap.

2. The image forming apparatus according to claim 1, wherein the substrate is mounted with a protective member that protects another electronic component mounted on the substrate by reducing an electric resistance in a case where a predetermined voltage or more is applied.

3. The image forming apparatus according to claim 1, wherein a plurality of the vent holes is provided, and the sheet member includes a plurality of the holes at positions corresponding to the vent holes.

4. The image forming apparatus according to claim 1, wherein in a region where the exterior and the sheet member overlap with each other, a sum of opening area of the hole is larger than that of opening area of the vent hole.

5. The image forming apparatus according to claim 1, further comprising a holding member configured to hold the substrate, wherein the holding member is in contact with the sheet member.

6. The image forming apparatus according to claim 1, wherein the sheet member is formed in the loop shape by bonding a single sheet at a bonding portion.

7. The image forming apparatus according to claim 6, wherein the bonding portion bonds the sheet by a double-sided tape.

8. The image forming apparatus according to claim 1, wherein the sheet member is a polyethylene terephthalate (PET) sheet.

* * * * *